United States Patent [19]

Sample

[11] Patent Number: 4,760,880

[45] Date of Patent: Aug. 2, 1988

[54] COMBINATION ANCHOR

[75] Inventor: Clark M. Sample, Bakersfield, Calif.

[73] Assignee: Steve Lichfield, Santa Maria, Calif.

[21] Appl. No.: 61,558

[22] Filed: Jun. 15, 1987

[51] Int. Cl.[4] ..... E21B 23/02; E21B 33/12

[52] U.S. Cl. ..... 166/118; 166/64; 166/382; 166/385

[58] Field of Search ..... 166/118, 64, 136, 135, 166/105.5, 106, 206, 237, 214, 385, 387

[56] References Cited

U.S. PATENT DOCUMENTS

| | | | |
|---|---|---|---|
| 2,613,746 | 10/1952 | Whitney | 166/136 X |
| 2,671,512 | 3/1954 | Ragan et al. | 166/136 |
| 2,816,613 | 12/1957 | Minter et al. | 166/237 X |
| 2,922,477 | 1/1960 | Wall, Jr. et al. | 166/136 |
| 3,756,316 | 9/1973 | Ruth | 166/135 X |
| 4,488,597 | 12/1984 | Hoppe et al. | 166/385 X |

*Primary Examiner*—Stephen J. Novosad
*Attorney, Agent, or Firm*—Rapkin, Gitlin, Moser & Schwartz

[57] ABSTRACT

The present invention in its preferred embodiment comprises a combination anchor including a first tubular member having a circular shoulder formed around the perimeter of its bore. Adapted to be releasably inserted inside the tubular member is a bullplug comprising a cylindrical shaped plug member with a rounded bottom section and a seat ring adapted to be threadedly connected to the top section of the plug member. Adapted to be connected to the seat ring and plug member by means of cooperating threads is a mandrel. A conical member having a plurality of compressible legs depending therefrom is insertable over the mandrel and secured thereon by a cap member which fits over the conical member and may be attached thereto by means of cooperating threads. Threadedly connected to the top of the cap and extending upwardly into the bore of the tubing string is a rod, which is more commonly known in the trade as a rod sub. At the end of this rod sub is the male counterpart of a locking device known as a J-latch pin. In the seated position, and shoulder formed in the bore of the first tubular member creates an impervious seal through means of its direct and secure engagement with the depending legs of the conical member on the top and the seat ring situated below.

11 Claims, 3 Drawing Sheets

COMBINATION ANCHOR

FIELD OF THE INVENTION

This invention relates generally to the field of oil and gas production equipment and more particularly to a combination anchor assembly adapted for releasable connection to the bottom of a gas anchor.

DESCRIPTION OF THE PRIOR ART

Current procedure used in the production of oil and gas wells is to drill the well bore first, set a casing string down the hole to prevent caving and then run a tubing string down the hole through the bore of the casing string. Rods from the pumping unit on the surface are installed down the bore of the tubing string and connect to the pump at the bottom of the well. There are generally two types of rods. Polished rods are the connecting link between the pumping unit on the surface and the sucker rod string inside the tubing string. Sucker rods are solid high grade steel rods that are run inside the tubing string that connects the pumping unit on the surface to the pump on the bottom of the well. Connected to the bottom of the tubing string is a section of tubing known as the gas anchor, and attached to the bottom section of the gas anchor is a relatively short tubular shaped device which is commonly referred to as a shoe. Located inside the shoe is a bullplug, which permanently seals the end of the gas anchor and prevents the entry and exit of gas and fluids therethrough. The principal disadvantage associated with the prior art procedures and apparatus described heretofore is the inability of the well operator to easily and inexpensively determine the distance from the well surface to the bottom of the well bore and/or the character or level of the "fill" building up therein.

In the production of oil and gas wells in accordance with the prior art, the need often arises for determining the distance from the well surface to the bottom of the well bore. Build up of minerals, sand and other deposits in the bottom of the well bore, i.e. "fill," can sometimes create a multitude of production problems, particularly if the level of the "fill" interferes with the production flow of fluids or gases from the well bore to the surface. On these occasions, it will usually be necessary to run a sand line down the tubing string to determine the distance to the bottom of the well bore and/or the character and existing level of the "fill" build up. In accordance with the technology taught by the prior art, a permanent bullplug seated in the bottom of the gas anchor cannot be dislodged. Thus, when the need arises to drop a sand line down the well to determine the distance from the well surface to the bottom of the well bore and/or the character or level of the "fill," the rods, the pump and the entire tubing string must first be pulled from the hole. The sand line may then be lowered down the well casing string for accomplishing the aforesaid purpose. The entire process, as described heretofore, is both extremely time consuming and costly.

The device of the present invention comprises a bullplug assembly which is releasably positioned at the bottom end of the gas anchor and seated tightly inside the bore of the shoe about a circular shoulder formed around the bore's perimeter. Connected to the top end of the bullplug assembly and extending upwardly through the bore of the tubing string is a length of rod commonly referred to as a rod sub. Attached to the upper end of the rod sub is a J-latch pin. Until the need arises to unseat the bullplug from the bottom of the gas anchor, the combination anchor assembly remains stationary inside the bottom of the gas anchor.

To operate the device of the present invention, the rods and the pump inside the tubing string are first removed from the well. A sand line comprised of a heavy metal cable, several stands of rods connected in sequence to the lower end of the sand line, and a bumper sub, which is attached to the other end of the rod stands, are then lowered down the bore of the tubing string. A bumper sub is comprised of two main rods of generally equal diameter connected by a third or intermediate rod with a smaller diameter. The intermediate rod is affixed to the end of one of the main rods and connected in slidable relation to the end of the other. Attached to the lower end of the bumper sub is a J-latch catcher adapted to connect to the J-latch pin. Using the combined weight of the sand line, the rod stands and the bumper sub, the J-latch pin and J-latch catcher are caused to engage one another and with a slight rotation of the aforesaid assemblage of elements form a secure connection. Once the J-connection is secured, the sand line, rod stands and bumper sub are pulled toward the surface until the bumper sub is extended the entire length of the intermediate rod member, or any substantial portion thereof. The sudden release of the assemblage comprising the sand line, rod stands and bumper sub aided by their substantial weight combine to create a sufficient downward force to cause the bullplug to unseat and the entire assembly to drop out the bottom of the shoe. By tagging or flagging the sand line at the surface before the bullplug assembly is unseated and then tagging it again when the bullplug touches the bottom of the well bore or engages the "fill," the well operator can determine the exact distance from the surface to the bottom of the well and/or the character and level of the "fill." By reversing this procedure, the entire assembly may easily be brought back up through the opening in the bottom of the gas anchor and the bullplug may be reseated around the shoulder formed inside the bore of the shoe. The sand line, rod stands and the bumper sub may then be pulled to the surface and retrieved from the well.

The device of the present invention solves many of the major problems associated with the prior art technology wherein costly and inefficient methods are usually involved in determining the distance to the bottom of the well bore and/or the character and upper level of the "fill." In contrast, the present invention enables this same information to be obtained in a safe and relatively inexpensive and simple manner.

The advantages and distinctions of the present invention over the prior art will become clearly evident in the following disclosure.

SUMMARY OF THE INVENTION

The present invention in its preferred embodiment comprises a combination anchor including a first tubular member having a circular shoulder formed around the perimeter of its bore. Adapted to be releasably inserted inside the tubular member is a bullplug comprising a cylindrical shaped plug member with a rounded bottom section and a seat ring adapted to be threadedly connected to the top section of the plug member. Adapted to be connected to the seat ring and plug member by means of cooperating threads is a mandrel. A conical member having a plurality of compressible legs depending therefrom is insertable over the mandrel and secured thereon by a cap member which fits over the conical member and may be attached thereto by means of cooperating threads. Threadedly connected to the top of the cap and extending upwardly into the bore of the tubing string is a rod, which is more commonly known in the trade as a rod sub. At the end of this rod sub is the male counterpart of a locking device known as a J-latch pin. In the seated position, the shoulder formed in the bore of the first tubular member creates an impervious seal through means of its direct and secure engagement with the depending legs of the conical member on the top and the seat ring situated below.

To operate the device of the present invention, the polished and sucker rods and the pump inside the tubing string are first removed from the well. A sand line comprised of a heavy metal cable, a series of rod stands and a bumper sub are connected to each other in the sequence indicated and then lowered down the bore of the tubing string. A bumper sub is comprised of two main rods of generally equal diameter connected by a third or intermediate rod with a smaller diameter. The intermediate rod is affixed to the end of one of the main rods and connected in slidable relation to the end of the other. Attached to the lower end of the bumper sub is a J-latch catcher adapted to connect to the J-latch pin. Using the weight of the sand line, rod stands and bumper sub, the J-latch pin and J-latch catcher are caused to engage one another and with a slight rotation of the aforesaid assemblage of elements form a secure connection. Once the J-connection is secured, the sand line, rod stands and bumper sub are pulled toward the surface until the bumper sub is extended the entire length of the intermediate rod member, or any substantial portion thereof. The sudden release of the assemblage comprising the sand line, rod stands and bumper sub aided by their substantial weight combine to create a sufficient downward force to cause the bullplug to unseat and the entire assembly to drop out the bottom of the shoe. By tagging or flagging the sand line at the surface before the bullplug assembly is unseated and then tagging it again when the bullplug touches the bottom of the well bore or engages the "fill," the well operator can determine the exact distance from the surface to the bottom of the well and/or the character and level of the "fill." By reversing this procedure, the entire assembly may easily be brought back up through the opening in the bottom of the gas anchor and the bullplug may be reseated around the shoulder formed inside the bore of the shoe. The sand line, rod stands and bumper sub may then be pulled to the surface and retrieved from the well.

An object of the present invention is to provide a releasable bullplug assembly that allows a sand line direct access to the bottom of the well bore through the gas anchor to determine the exact distance from the surface to the bottom of the well bore and/or the character and level of the "fill" therein.

Another object of the present invention is to provide a releasable bullplug assembly that retains the advantages and benefits previously associated with a permanently sealed or closed gas anchor.

Still another object of the present invention is to provide a bullplug assembly that may easily be seated or unseated by the surface manipulation of an operator.

Yet still another object of the present invention is to provide a bullplug assembly that maximizes the potential for production related cost controls.

Still another object of the present invention is to provide a bullplug assembly that is convenient and easy to use and inexpensive to manufacture.

Other objects and advantages of the present invention will become apparent in the following specifications when considered in light of the attached drawings wherein a preferred embodiment of the invention is illustrated.

A BRIEF DESCRIPTION OF THE DRAWINGS

DETAILED DESCRIPTION OF THE PREFERRED EMBODIMENT

Figure 1:
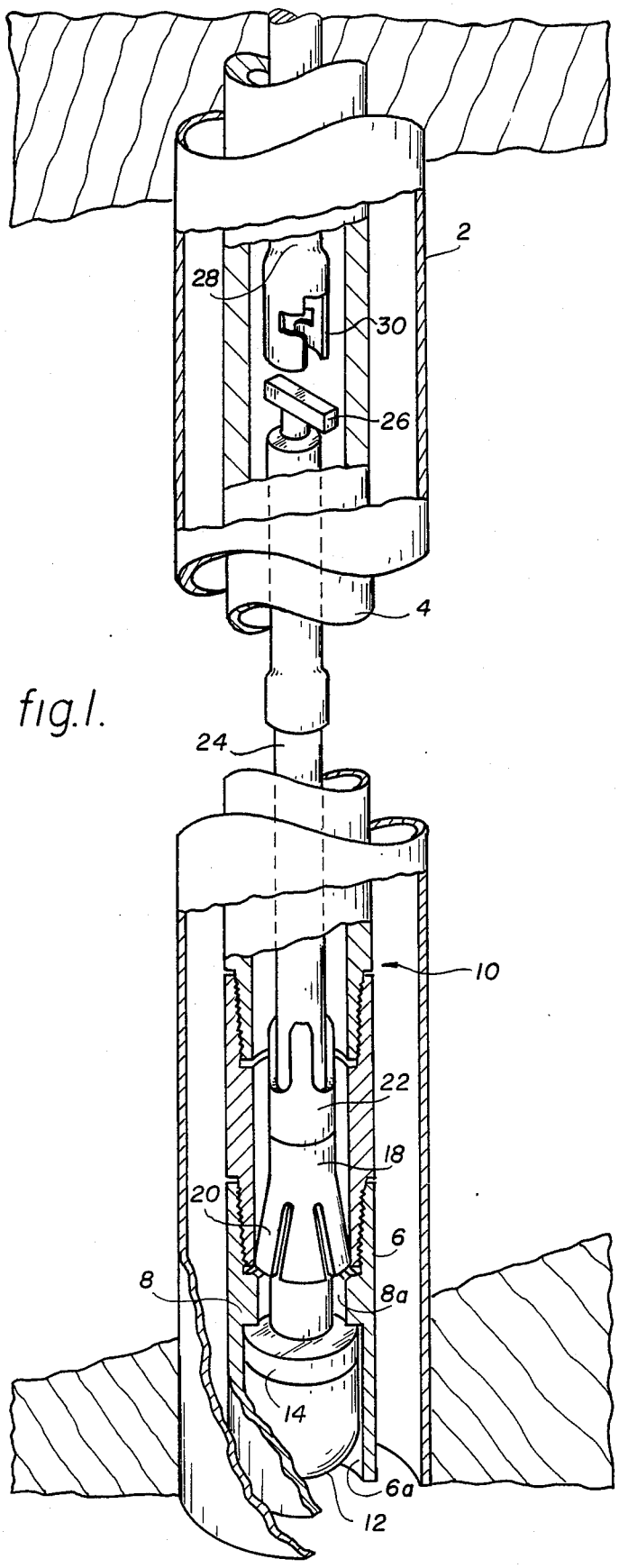
FIG. 1 is a partially cut away elevational view of the bullplug assembly and related apparatus in accordance with the present invention illustrating the bullplug assembly in its seated position inside the inverted shoe.
Figure 2:
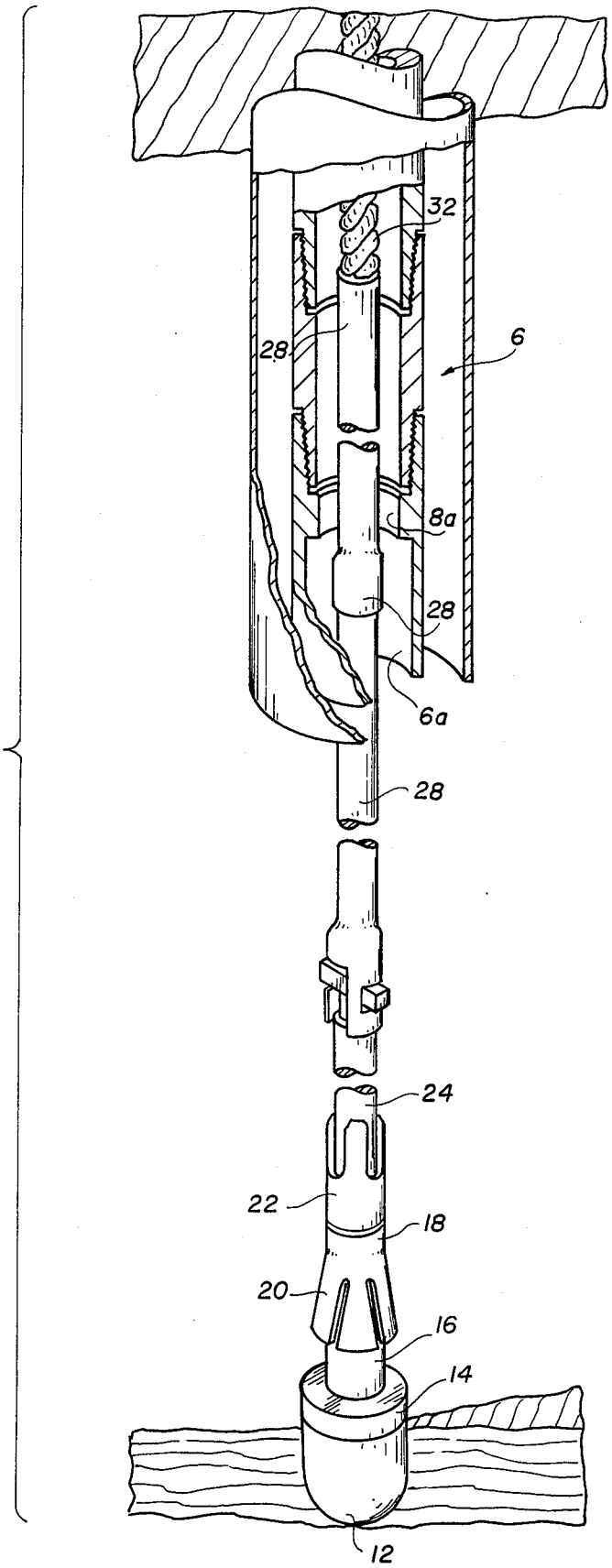
FIG. 2 is a partially cut away elevational view of the present invention illustrating the unseated bullplug assembly resting on the bottom of the well bore.
Figure 3:
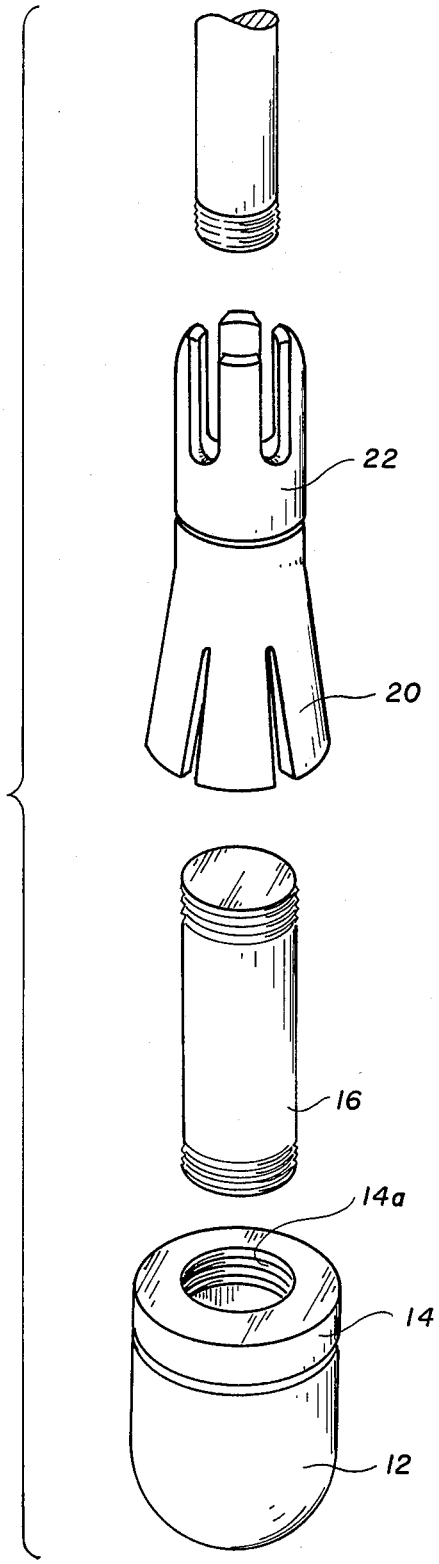
FIG. 3 is an exploded view of the bullplug assembly in accordance with the present invention.

Referring more particularly to the drawings, FIG. 1 indicates the combination anchor in accordance with the present invention and more specifically a partially cut away elevational view of a section of tubing string 4 installed down a well bore inside a casing string 2. Toward the bottom of tubing string 4 is a gas anchor 10, which essentially comprises a lower section of tubing string and terminates at its lower end with a cylinder more commonly referred to as a shoe 6. Around the perimeter of the bore **6*a* of shoe 6 is a circular shoulder 8**. It should be understood that all of the individual elements comprising the present invention as well as the other oil and gas production equipment described herein are constructed of metal, although it is conceivable that other resilient materials may be utilized instead.

Adapted to be releasably inserted inside the bore **6*a* is a bullplug assembly comprising a semi-spherical shaped plug member 12 with an opening at the top and a rounded bottom section, and a seat ring 14 adapted to be threadedly connected to the top section of plug member 12. Mandrel 16 is connected to the seat ring 14 and plug member 12 by means of cooperating threads located at the bottom end of mandrel 16 and inside the bore 14*a* of seat ring 14. A conical member 18 having a plurality of compressible legs 20 depending therefrom is insertable over the mandrel 16. Conical member 18 slips over the shaft of mandrel 16 and is secured in place by a cap member 22. Cap member 22 is tightly affixed to the top end of mandrel 16** by means of cooperating threads.

Threadedly connected to the bullplug assembly and extending upwardly into the bore **4*a* of the tubing string 4 is a rod 24. At the opposite end of rod 24 is the male counterpart of a locking device known as a J-latch pin 26**.

In the seated position, the shoulder 8 is interjacent the legs 20 and seat ring 14 whereupon an impervious seal is formed to prevent the exit and entry of gases and fluids through the bottom opening of the gas anchor 10.

In its operative state, the polished and sucker rods and pump (not shown) are pulled from the well where they were situated in the bore 4a of the tubing string 4. A sand line 32, which is usually comprised of a heavy metal cable or the like, a plurality of rod stands 28 and a bumper sub (not shown), all connected to each other in the sequence indicated, are then lowered down the tubing string 4 in the reverse order by a device at the surface. The bumper sub is comprised of first and second rod members (not shown) of generally equal diameter and length, and an intermediate rod member which acts to connect the first and second rod members. One end of the intermediate rod member is fixedly secured to one end of the first rod member and the other end of the intermediate rod member is connected to the second rod member in slidable relation therewith so that the first and second rod members may be brought into direct physical engagement with each other and, where desired, separated in telescopic fashion to a distance equal to the length of the intermediate rod member, or any portion thereof. Attached to the bottom end of the bumper sub is a J-latch catcher 30. Using the downward force created by the substantial combined weight of the elements comprising the sand line 32, rod stands 28 and the bumper sub, J-latch 30 is adapted to engage and, with a slight rotation of the aforesaid elements, lock onto J-latch pin 26.

When the J-latch pin 26 and the J-latch catcher 30 engage and are secured tightly to one another, the sand line 32, rod stands 28 and the bumper sub are pulled toward the surface until the bumper sub is extended the full distance of the intermediate rod member, or any substantial portion thereof. A sudden release of the aforesaid elements aided by their substantial weight combine to create a downward force that will suffice to unseat the bullplug assembly and allow it to drop out the bottom of the tubular member 6.

The sand line 32 may be flagged at the surface before the bullplug assembly is unseated and then flagged again when the assembly touches the bottom of the well bore or engages the "fill." In so doing, the operator at the surface can determine the exact distance from the surface to the bottom of the well and/or the character and upper level of the "fill."

The bullplug assembly may again be seated inside the tubular member 6 by pulling upwardly on the assemblage comprising the sand line 32, rod stands 28 and the bumper sub until legs 20 are brought into contact with the bore 8*a* of shoulder 8. Legs 20 then compress as they engage and pass through the bore 8*a* and expand again when the shoulder 8 is tightly interjacent the legs 20 and seat ring 14 wherein the engagement of same forms an impervious seal through which well gases and fluids may not pass. J-latch pin 26 and J-latch catcher 30 are then disconnected by a reverse rotational movement of the sand line 32, rod stands 28 and the bumper sub, which may then be pulled to the surface and retrieved from the well.

Because of the considerable weight of the sand line 32, rod stands 28 and the bumper sub pressing down upon the bullplug assembly (See FIG. 1) secured inside shoe 6, legs 20 have a tendency at times to slip from its usual position in contact with the upper surface of shoulder 8 and encroach upon the bore 8*a*. In so doing, the impervious seal normally created by the secure engagement of legs 20 and seat ring 14 with shoulder 8 begins to weaken and eventually could break allowing the well fluids and gases to pass through at will. To prevent this, a second shoulder (not shown) may be formed inside shoe 6 at a location below shoulder 8. Interposed between seat ring 14 and plug member 12 is a second conical member (not shown) having depending legs (not shown) which are designed to engage the top surface of the second shoulder. This provides the additional support necessary to counter the combined weight of the sand line 32, rod stands 28 and the bumper sub and maintain the integrity of the impervious seal created by legs 20 and seat ring 14 in engagement with shoulder 8.

While the invention will be described in connection with a certain preferred embodiment it is to be understood that it is not intended to limit the invention to that particular embodiment. Rather, it is intended to cover all alternatives, modifications and equivalents as may be included within the spirit and scope of the invention as defined by the appended claims.

I claim:

1. A combination anchor including a removable plug device adapted for placement in conjunction with a tubing string, rod string and gas anchor in a well bore, which comprises:

a. a tubular member adapted to be connected to the bottom end of said gas anchor, said member including a circular shoulder formed around the inside of the bore thereof;
b. a plug means;
c. a seat ring adapted to be connected to said plug means;
d. a conical sleeve member having a plurality of compressible legs depending therefrom;
e. a cap member; and,
f. a mandrel adapted to be connected at one end thereof to said ring and said plug, and at the other end thereof to said conical sleeve member and said cap.

2. The invention of claim 1, wherein said plug means, seat ring, conical sleeve member, cap member and mandrel cooperate to form a generally unitary bullplug assembly which is adapted to be releasably seated inside the bore of said tubular member.

3. The invention of claim 2, wherein said shoulder is interjacent and releasably secured between said depending legs and said seat ring.

4. The invention of claim 3, wherein the bullplug assembly includes threaded means at one end thereof adapted to engage cooperating threads contained in the end section of a first rod member.

5. The invention of claim 4, wherein a first connector means is attached to the upper end of said first rod member.

6. The invention of claim 5, wherein a second connector means is attached to the bottom end of an assemblage of elements comprising in sequence from top to bottom a flexible connector means, a series of connected rod members and a bumper sub member.

7. The invention of claim 6, wherein said first and second connector means are adapted to engage and lock into one another.

8. The invention of claim 7, wherein said bumper sub member is comprised of second and third rod members of generally equal diameter and a fourth rod member located intermediate to said second and third rod members, said fourth rod member being fixedly attached to one end of said second rod member and slideably connected at the opposite end thereof to an end of said third rod member, whereupon said second and third rod members may be brought into direct engagement with one another or separated and extended in telescopic fashion to a maximum distance generally equal to the length of said fourth rod member.

9. The invention of claim 8, wherein said first and second connector means engage and lock into one another and said assemblage of elements are pulled toward the surface until said bumper sub is fully extended the distance of the length of the fourth rod member, whereupon the release of said assemblage of elements and the weight thereof combine to create a downward force sufficient to unseat said bullplug assembly from inside the bore of said first tubular member.

10. The invention of claim 6, wherein said flexible means comprises a metal cable.

11. The invention of claim 7, wherein said first and second connector means comprise a J-latch pin and J-latch catcher, respectively.

* * * * *